US006257258B1

(12) United States Patent
Smith

(10) Patent No.: US 6,257,258 B1
(45) Date of Patent: Jul. 10, 2001

(54) SEAT SUSPENDED BETWEEN CRUTCHES

(76) Inventor: John E. Smith, 4304 Calvert Cir., Frederick, MD (US) 21703

( * ) Notice: Subject to any disclaimer, the term of this patent is extended or adjusted under 35 U.S.C. 154(b) by 0 days.

(21) Appl. No.: 09/291,267

(22) Filed: Apr. 14, 1999

(51) Int. Cl.[7] ..... A45B 3/00; A45B 5/00; A47C 4/02; A61H 3/02

(52) U.S. Cl. ..... 135/66; 135/68; 297/129; 297/5; 280/812

(58) Field of Search ..... 135/66, 68; 280/812; 224/159, 160; 297/118, 129, 5

(56) References Cited

U.S. PATENT DOCUMENTS

| | | | | |
|---|---|---|---|---|
| 554,019 | * | 2/1896 | Collins . | |
| 768,882 | * | 8/1904 | Morse . | |
| 2,257,831 | * | 10/1941 | Wood . | |
| 2,339,007 | * | 1/1944 | Gahm . | |
| 3,538,512 | * | 11/1970 | Dolan . | |
| 3,874,687 | * | 4/1975 | Cadwalader | 297/129 X |
| 3,902,731 | * | 9/1975 | Fagen et al. | 297/129 X |
| 4,065,140 | * | 12/1977 | Cadwalder | 135/66 X |
| 4,315,655 | * | 2/1982 | Machnik | 297/118 |
| 4,394,045 | * | 7/1983 | Shaw et al. | 297/118 |
| 4,456,284 | * | 6/1984 | Saka | 280/812 |
| 4,786,082 | * | 11/1988 | Swietlik | 280/812 |
| 4,793,370 | * | 12/1988 | Perez et al. | 135/69 |
| 5,010,850 | * | 4/1991 | Sailer | 119/96 |
| 5,313,971 | * | 5/1994 | Upshaw | 135/68 |
| 5,348,035 | * | 9/1994 | Porter | 135/66 |
| 5,911,234 | * | 6/1999 | Hirst | 135/68 |

FOREIGN PATENT DOCUMENTS

1717135 * 7/1992 (SU) .

OTHER PUBLICATIONS

The Medical Recod, vol. 24, p. 136 A New Saddle–Crutch by James R. Taylor, M. D., Aug. 1883.*

* cited by examiner

*Primary Examiner*—Robert Canfield
(74) *Attorney, Agent, or Firm*—Joseph J. Zito; Kendal M. Sheets; David W. Ward

(57) ABSTRACT

A seat suspended between two crutches in the manner of a sling, to provide the user of the crutches with a place to rest. The seat is attached to both crutches of a pair of crutches used by an individual needing crutches. The seat is attached by one or more adjustable straps and/or release clips. The seat allows the user to rest his body weight on the seat thereby relieving the arms of the user without placing weight on the lower limbs. The crutches are fully usable in the normal manner for walking while the seat is attached and suspended from the crutches. The seat hangs below and behind the user when the crutches are used by the user for walking. The feet of the crutched are placed adjacent one another, while the tops of the crutches are spread apart to raise the seat into a usable height, while providing a stable base for supporting the user. The crutches are then angled slightly forward with the tops of the crutches in front of the user and the crutch feet behind the user. The user then lowers his weight onto the suspended seat and maintains his balance with his feet touching the ground. To continue walking, the user leans forward out of the crutches and shifts his weight to his arms.

7 Claims, 7 Drawing Sheets

SEAT SUSPENDED BETWEEN CRUTCHES

BACKGROUND OF INVENTION

1. Field of Invention

The present invention relates to portable medical devices for ambulatory patients. More particularly, the present invention relates to accessories for aiding individuals who require the use of crutches.

2. Description of the Related Art

An individual who suffers a leg, foot, or ankle fracture or sprain may require the use of crutches in order to remain mobile. Others may require long term or permanent use of crutches. In the treatment of a lower body injury or permanent disability where a conventional pair of crutches are required to provide support, a level of fatigue is incurred when the upper body must compensate for the lower body's inability to support weight. When using a pair of crutches many people complain of underarm soreness and upper body fatigue. The fatigue is caused by the constant use of the arms with the aid of the crutches to support weight.

To attempt to relieve arm fatigue, it is common for people on crutches to lean on the underarm supports, when not walking or moving about. Soreness under the arms often accompanies the use of crutches. Foam pads have been added to many crutches to help reduce this soreness which is often accompanied by a rash or rawness. Many people add towels etc. to give extra padding.

Others who may require the uses of crutches to remove weight from the affected area in the legs or hips include individuals suffering from arthritis, partial paralysis, accident victims, athletes etc. Sports injuries are common among athletes ranging from professional to amateur, to weekend participants. Knee and ankle injuries are the most common. Depending on the severity of the injury, the injured person may require the use of crutches from a few days to a few weeks or months. Auto accident victims etc. may be on crutches for years and possibly for the rest of their lives. Use for extended periods of time or the need to travel extended distances that lead to fatigue sometimes cannot be avoided. Athletes who need to stand on sidelines, people who are required to be on their feet at work, people who have a long walk in a parking lot or need to walk long distances for any reason all experience fatigue. Sometimes places to sit down are just not available. When there are places to sit there is the problem of where to put the crutches when they are not in use. Also it can be difficult to get up from a seat which is too low, when his/her injury and/or crutches hinder the individual.

In summary, problems associated with the use of standard crutches on their own are sometimes unavoidable. Problems include physical fatigue, discomfort and inconvenience these can force the user to use the injured part more than necessary. These issues pose a threat to the safety of the individual as well as making the crutches less effective and can increase the time necessary for recovery.

The present invention can reduce the adverse effects of the use of crutches. The healing process can be aided and the comfort of the user increased. The individual could possibly enjoy the same degree of mobility as that experienced before the injury including the possibility of returning to work.

SUMMARY OF INVENTION

The present invention is a seat that attaches to a conventional pair of crutches. Its purpose is to support the users weight to help eliminate fatigue which usually accompanies the use of crutches. The device is used when the individual using the crutches is stationary and acts as a seat so that the individual does not have to stand. This device is portable and can be removed for storage or left attached to a pair of crutches for easy access and immediate use.

The present invention is a helpful tool that helps with the above problems of fatigue and mobility. The present invention provides a support during rest by providing a suspended sling seat surface to sit on whenever and wherever the user may be. This will help prevent fatigue and soreness that usually accompany crutch use. By reducing the fatigue in the upper body and providing support to keep weight off the injured limbs, recovery time can be improved and the chance of re-injury can be reduced.

The present invention offers a solution to these problems by providing a surface to rest at all times and anywhere it is safe to use crutches. The suspended sling seat is attached to the arm support of the crutches and hangs behind the user. The present invention remains out of the way during non-use and is always there when then user needs a rest. The seat portion hangs down between the hand supports and with a little repositioning of the crutches provides a seat to lean back into. This takes the weight off of the upper body while still keeping the weight off the injured limb. The present invention is removable, lightweight and easy to use. The present invention is also adjustable which allows for different size users as well as a means to adjust for comfort and seat height. The present invention seat surface is also high enough so that it is much easier to get out of than a standard chair. This makes it easy to set up after sitting down especially if the user only has the use of one leg which can be a hindrance in getting up from a conventional seat.

To use the present invention the user simply repositions the crutches by positioning the feet of the crutches back and slightly together with removing the top of the crutches in a position slightly in front of the user's shoulders. The crutches are then in a V shape with the sling seat positioned across the V and under the posterior of the user. The user then leans back into a sitting/leaning position with his weight supported by the sling seat and his balance maintained by his feet on the ground.

BRIEF DESCRIPTION OF DRAWINGS

For a better understanding of the nature of the present invention, reference is had to the following figures and detailed description, wherein like elements are accorded like reference numerals, and wherein.

DETAILED DESCRIPTION OF PREFERRED EXEMPLARY EMBODIMENTS

Figure 1:
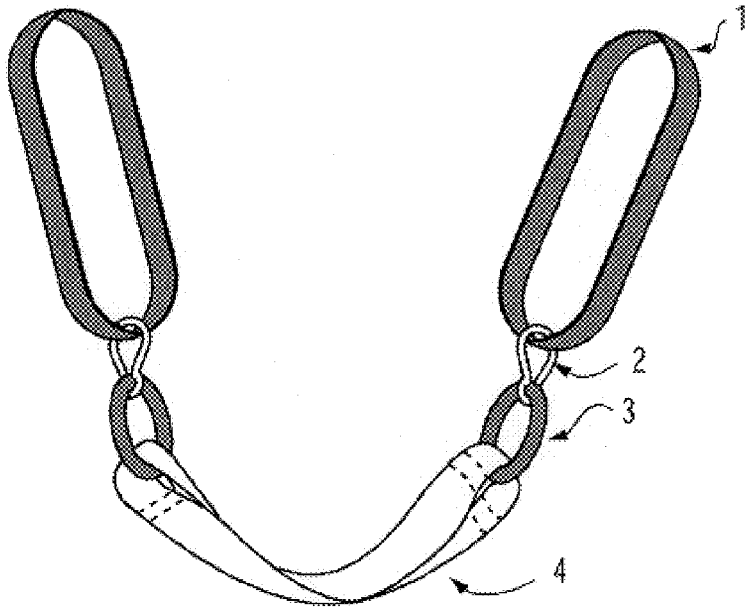
FIG. 1 is the a perspective view of the a first embodiment of the present invention.
Figure 2:
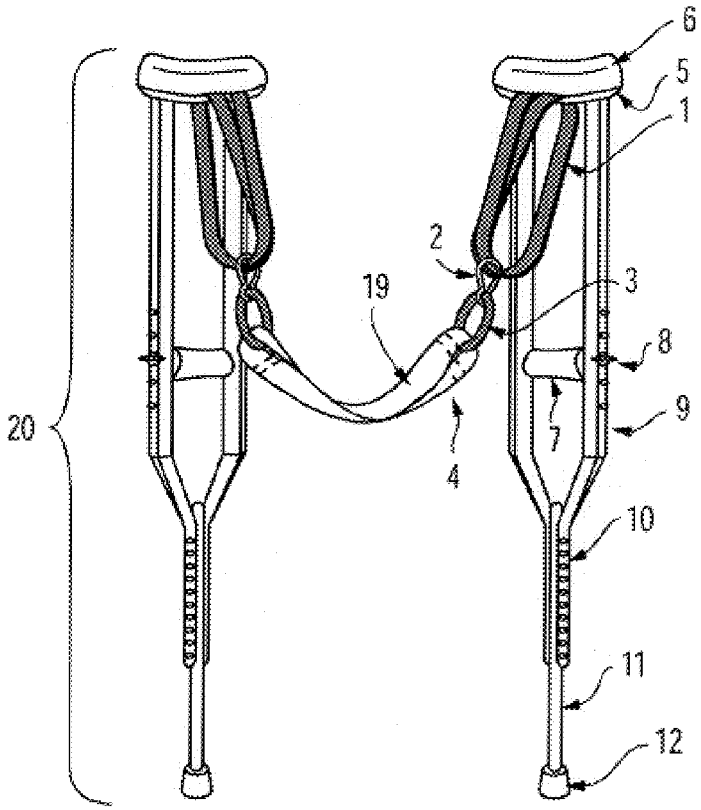
FIG. 2 is a perspective view of the first embodiment of the present invention suspended between a pair of crutches.

As illustrated in FIG. 1, a first exemplary embodiment of the present invention includes a seat 4, loops 3, links 2 and support straps 1. As illustrated in FIG. 2, the seat 4 is suspended between a pair of crutches. The seat 4 is attached to each crutch 20 by removing any padding 6 over the underarm support 5 and looping a support 1 over underarm support 5 and connecting loops 3 with connectors such as links 2.

In the embodiment illustrated in FIG. 1, seat 4 has loops 3 attached at each end. Loops 3 are closed loop sewn fabric which is loop through each end of seat 4. Support straps 1 are attached to each of the crutches 20. Once the support straps 1 are in place the foam pad 6 can be replaced on underarm support 5. FIGS. 5, 6, 7, 8, 9 and 10 illustrate alternative embodiments for the support straps 1, including adjustable straps 14 and strap 16. A pair of removable snap links 2 are used to connect seat loops 3 to support straps 1. Removable links 2 are used so that the seat 4 can be removed and replaced if desired, without the need to remove the support straps 1. Although the crutches 20 may be used for walking while the seat is attached, it may be desirable to remove the seat, or to suspend the seat from a single crutch when the user is walking. It also may be desirable to remove the seat 4 for cleaning or to seats as desired by the user.

Figure 10:
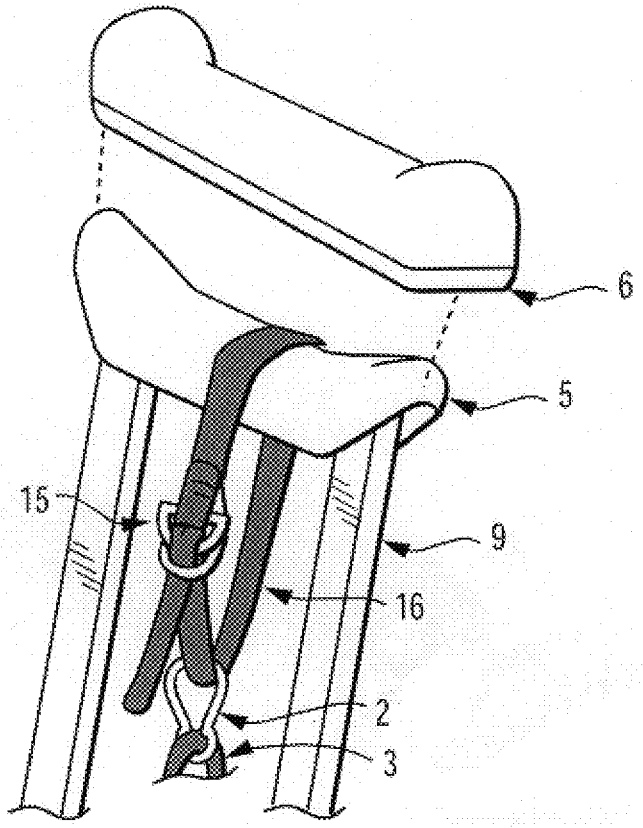
FIG. 10 is a perspective view illustrating the use of a second exemplary adjustment mechanism to adjust the length of an exemplary support strap.

Alternatively, seat 4 can be attached between crutches 20 without the use of links 2. One of the loops 3 on one side of seat 4 can be fixed directly to support strap 1 while a single link 2 is provided on the opposite side. Alternatively, adjustable straps 16, as illustrated in FIG. 10, can extend directly through loops 3 before securing the double D ring connection 15. Use of two links 2 however, does allow for the various configurations of straps 1 as illustrated in FIGS. 1, 5, 6, 7 and 8 which allows for a wide range of height adjustment with a single set of simple straps 1.

Figure 3:
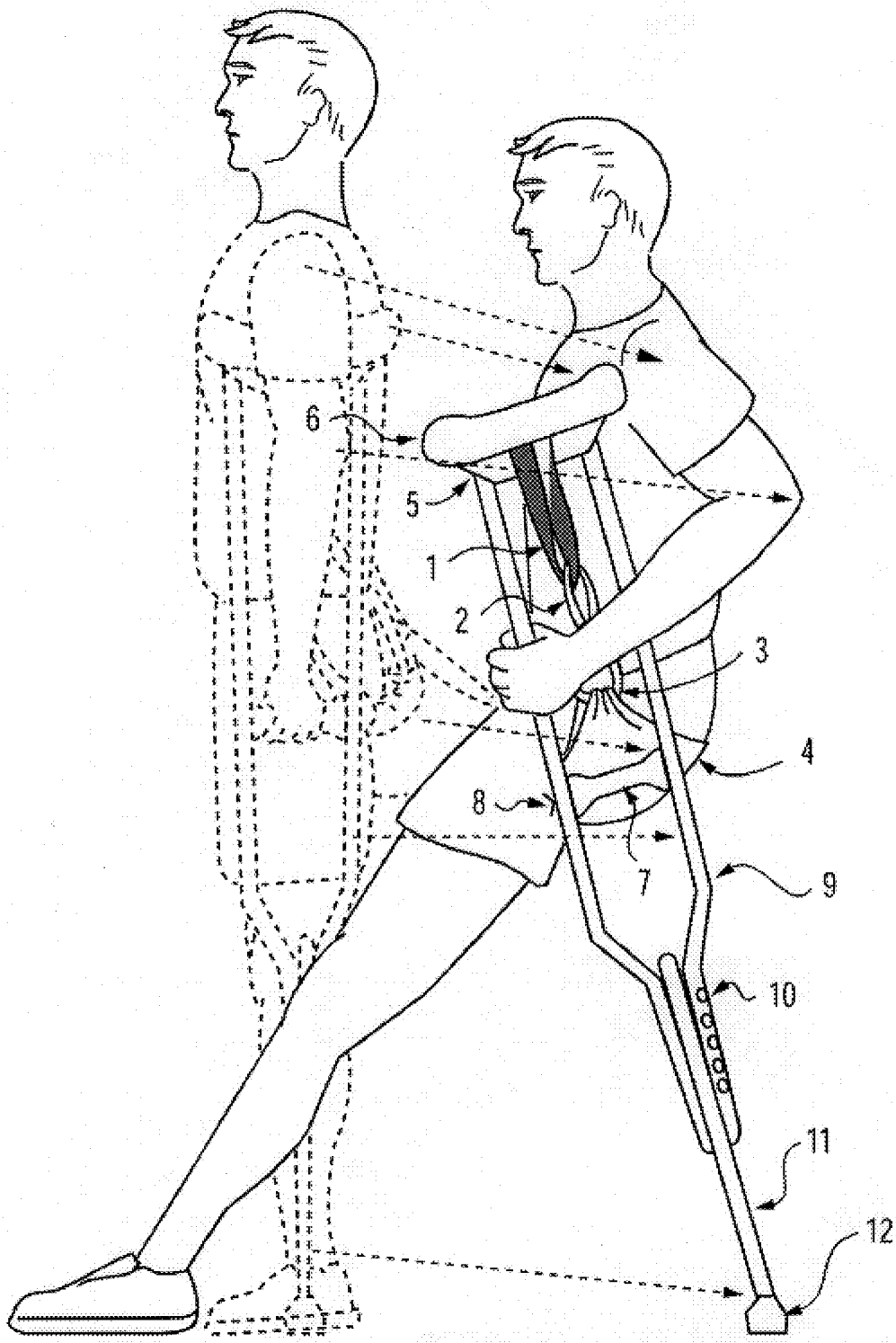
FIG. 3 is a side process view of the present invention illustrating the positioning of the crutches and the present invention in relation to a user.

As illustrated in FIG. 3, once the seat 4 is suspended between crutches 20 in the manner of a sling, the user would position himself in front of the seat 4 so that the pair of crutches 20 can be us ed in the normal fashion with the seat 4 hanging behind them, illustrated by the user in outlined position in FIG. 3. When the user chooses to use the present invention they would angle the lower legs 11 of crutches 20 back and slightly inward creating a "V" shape with the pair of crutches 20 (see FIG. 11). The underarm supports 5 are positioned in front of the body creating a triangle. The user then sits or leans back into the top surface 19 of seat 4 for support of body weight. Stability is provided by the two legs of the crutches 20 and with the one or two legs of the user. When the user chooses to get up and begin walking again he simply uses the hand supports 7 to aid in getting up and begin walking. The present invention then remains behind the user until its next use.

In an exemplary embodiment, the support strap 1 can be a single strap sewn together to create a loop. The strap 1 can be arranged in a variety of ways to provide adjustment in seat height. In one embodiment, illustrated in FIGS. 5 and 6 the support strap 1 is draped over the underarm support 5 and snap link 2 is attached to both ends of the loop 1. With the exemplary length loop, this provides a seat height approximately level with hand supports 7.

Figure 7:
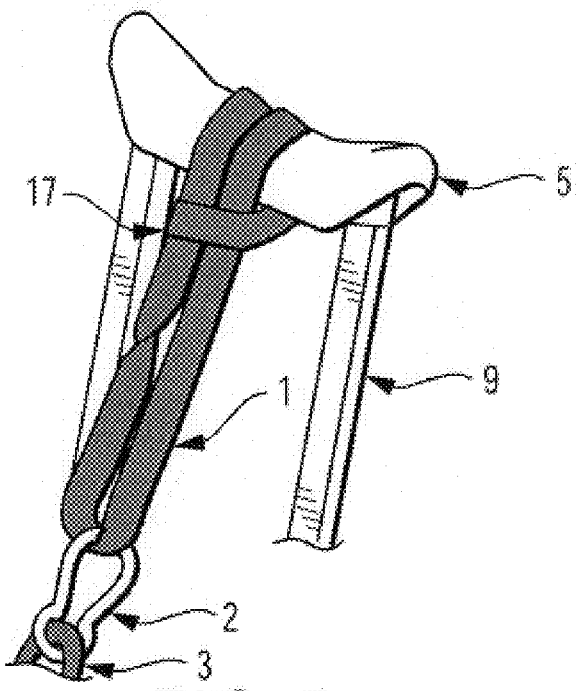
FIG. 7 is a perspective view illustrating an exemplary second attachment configuration.

An alternative embodiment, illustrated in FIG. 7, depicts an adjustment to allow a lower placement of the seat 4. This length of strap 1 is created by draping the support strap 1 over underarm support 5 and threading one end of support strap 1 through itself on the other side of underarm support 5 creating the knot 17 depicted in FIG. 7. The long end of this loop attaches to snap link 2, which connects the support strap 1 to the seat loop 3. This places the seat height below the hand supports 7. This provides a slightly longer attachment, which could accommodate a larger person or allow the user to sit lower between the crutches.

Figure 8:
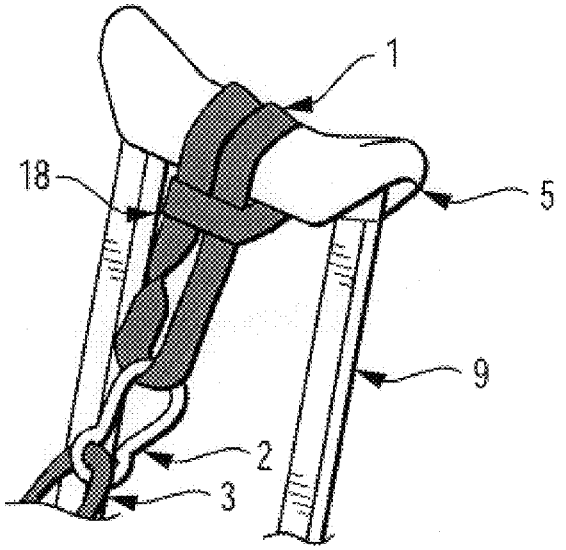
FIG. 8 is a perspective view illustrating an exemplary third attachment configuration.

Another alternative embodiment, as illustrated in FIG. 8 provides a higher seat placement. Once support strap 1 is draped over the underarm support 5 and threaded through itself as illustrated in FIG. 7, the long end of the support strap 1 is wrapped around underarm support 5 a second time and once again threaded through the opposing end of support strap 1 creating knot 18 as depicted in FIG. 8. This creates a very short attachment point for the snap link 2 which when attached to seat loop 3 creates a higher seat position above the hand supports 7. This could accommodate a smaller person or provide a higher seat position for the present invention.

Alternatively, support strap 1 can be constructed out of a strap of material which includes an adjustment mechanism, instead of a single strap sewn together to create a loop. Any of a number of types of buckles and fasteners can be used, the exemplary embodiments described below are for illustrative purposes only.

Figure 9:
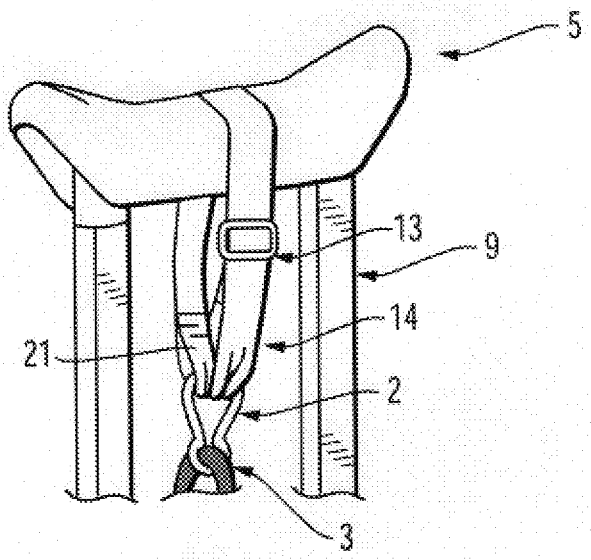
FIG. 9 is a perspective view illustrating the use of an exemplary adjustment mechanism to adjust the length of an exemplary support strap.

One embodiment, FIG. 9, illustrates a support strap made with the use of a slide buckle 13 that is attached at the middle to the webbing 16. Once a slide buckle 13 is threaded with one of the ends of webbing creating an adjustable loop 14 at one end a securing loop 21 is sewn at the other as depicted in FIG. 9. Both this securing loop 9 and the open end of the adjustable loop may attach to the snap link 2 creating a strong and adjustable support strap. The slide buckle 13 will need to be made of highly durable substance such as steel to support a lot of weight.

Another alternative, illustrated in FIG. 10 shows the use of two "D" rings 15 which function to provide adjustability in a manner well known in the art. One end of the webbing is threaded through two "D" rings and sewn to it to provide a secure attachment. To create a support strap 16, the open end of the strap is threaded through both "D" rings and then passed back between the two rings splitting them. The length of the loop can be adjusted to suit the user of the present invention. With this type of strap 16 using fastener 15, the use of snap link 2 is optional as the connection may be made directly by threading the end of strap 16 through seat loop 3.

Alternatively, a standard belt buckle fastener, Velcro or a number of other common fasteners can be used to secure a strap to the support 5 of a crutch for attachment of seat 4, all within the scope of the teachings of the present invention. Many of these types of fasteners would also not require the use of a snap link.

Figure 4:
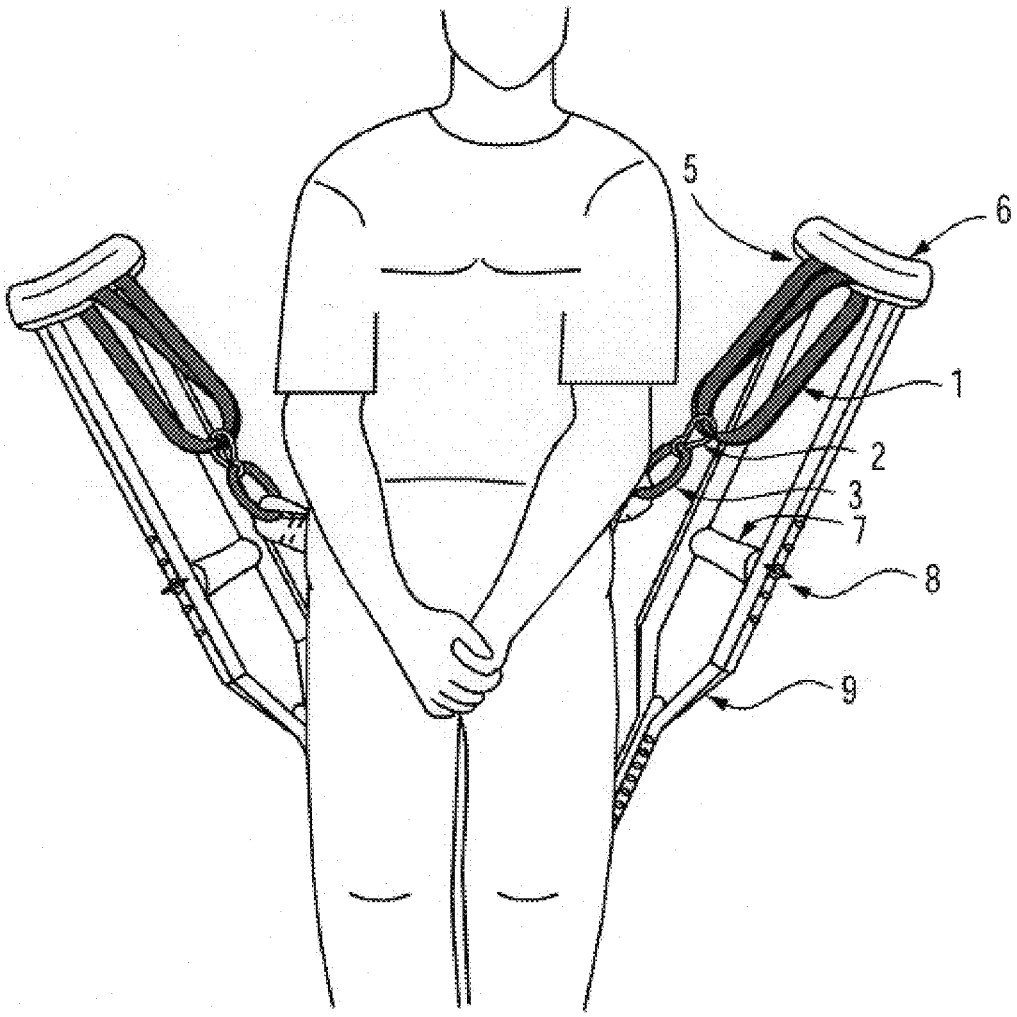
FIG. 4 is a front view of the present invention in use.
Figure 5:
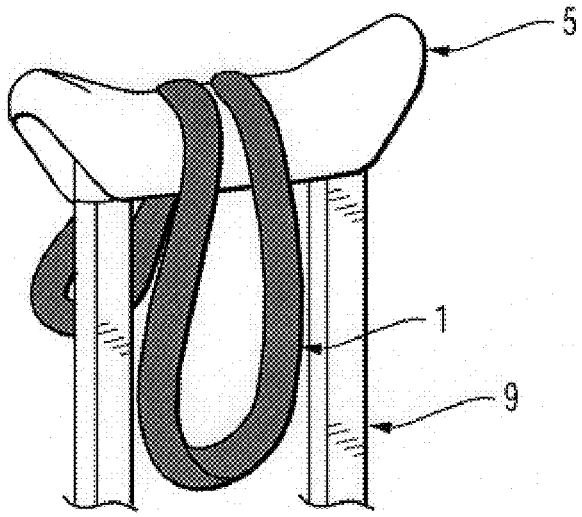
FIG. 5 is a perspective view illustrating the attachment of an exemplary embodiment of a support strap to a crutch.
Figure 6:
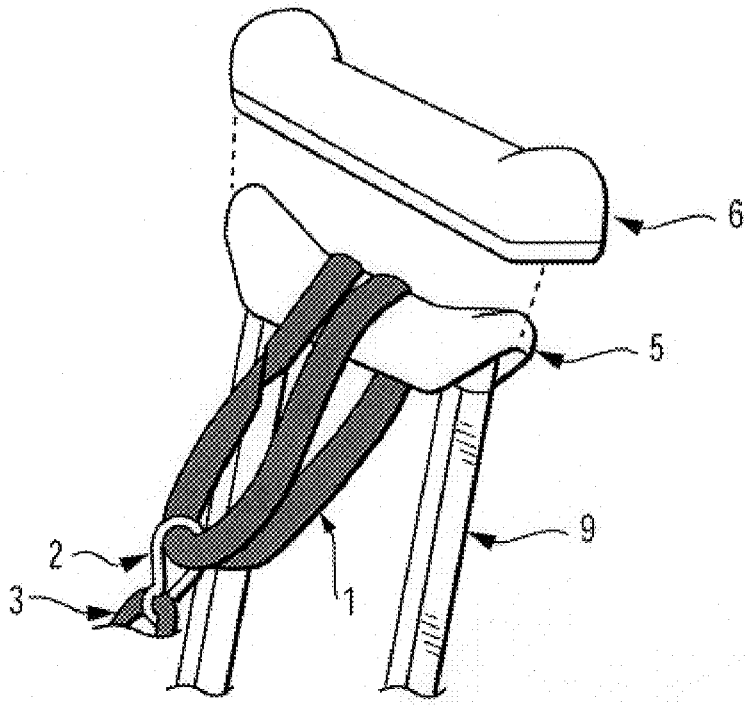
FIG. 6 is a perspective view illustrating an exemplary first attachment configuration.
Figure 11:
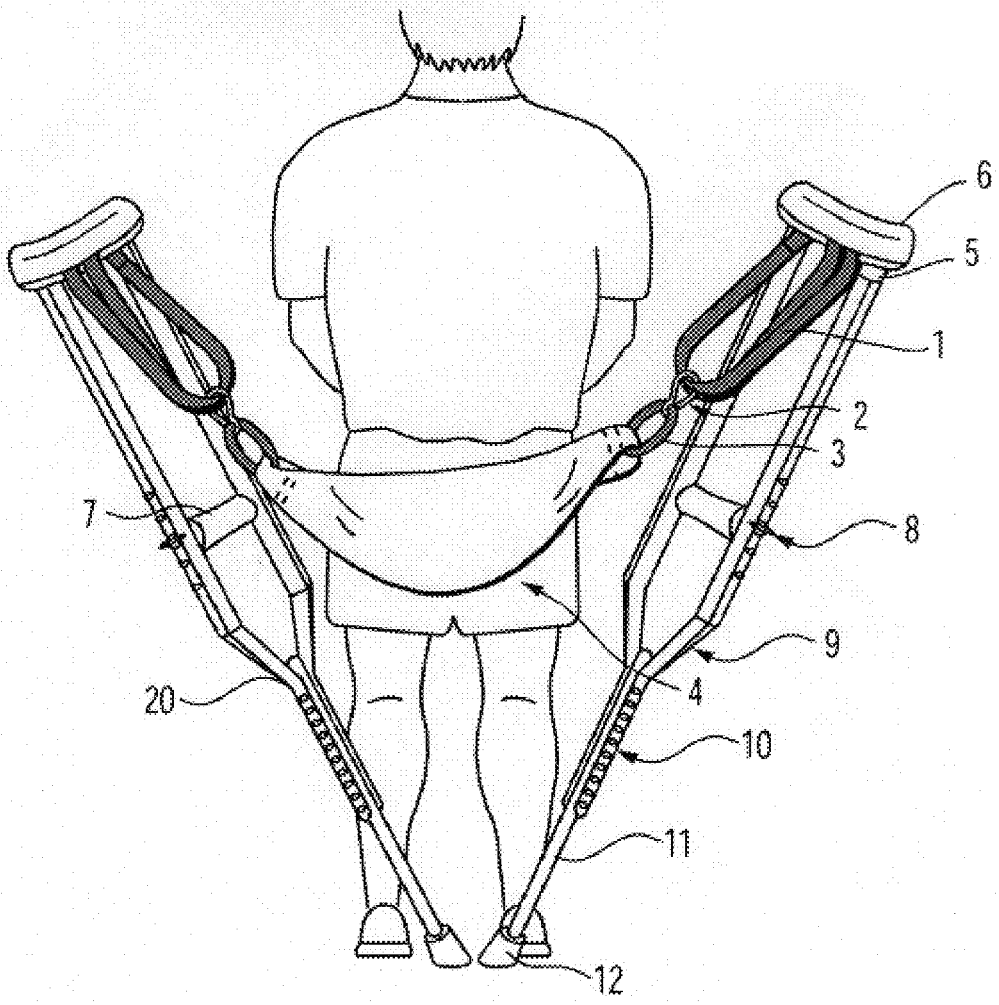
FIG. 11 is a back view of the present invention in uses, illustrating the positioning of the crutches when the present invention is in use.

FIGS. 4 and 11 illustrate how a users is balanced when seated in the present invention. The proper positioning of the crutches 20 allows for unobstructed use of arms while being supported. For proper support and stability, the crutches form a V shape and are tiled slightly forward. The feet 12 of the crutches 20 should be adjacent but do not need to be contacting each other. The configuration of the present invention and the crutches provides a seat which is safe and stable on any surface where the use of crutches in a normal manner would be secure. This seat is fully portable and can be used in any location accessible by the user of the crutches. The user assumes a sitting position which is higher than that of a normal seat, therefore allowing the user to return to his feet for walking without assistance often required to get up form a normal seat when the users in rehabilitating an injury or has diminished capacity. Further, the user does not have to find a place for his crutches when he is seated, nor does the user risk leaving the crutches behind when he stands. The crutches are always accessible to the user without the need to seek assistance in retrieving crutches which may be place out of reach of a conventional seat.

Below are possible alternative embodiments for some of the elements of the present invention. The alternatives are within the inventive scope herein taught however, the list is not exhaustive of alternative implementations of the inventive concept of the present invention.

Support strap 1 can be constructed of nylon tubular webbing or material of comparable strength. The exemplary loop is made using a 30-inch length of webbing sewn into a loop with a 1 to 2-inch overlap, sewn with durable nylon thread. Three support seams are sufficient.

Variations on this support strap include but are not limited to, a strap created with the use of a buckle like that of a standard belt, a single strand of webbing or like substance sewn at one end to two D-ring fasteners. This type of fastener attaches directly to the seat loops and is then secured with the use of the two D-rings. A support strap made with the use of a slide buckle which is attached at the middle to the webbing and is threaded with the other end of webbing creating an adjustable loop at one end while a securing loop 21 is sewn at the other. Securing loop 21 is made by folding back an end of the webbing 1–2 inches and sewing the webbing to itself. Both this securing loop and the open end of the adjustable loop may attach to the snap link creating a strong and adjustable support strap. The slide buckle will need to be made of highly durable substance such as steal to support a lot of weight.

A support strap utilizing a Velcro closure could work if it can support sufficient amount of weight. A support strap may utilize heavy duty snaps to provide closure or adjustment. A support strap may utilize buttons sewn into loop material to supply support and/or allow for adjustment. A variation on support strap material may also be available in the forms of: leather, rope, polyester, cloth or the like.

The exemplary snap link 2 is a steel link with a spring closure, such as a carabineer link used for rock climbing, with weight test exceeding 500 lbs. The snap link 2 can be substituted by a carabineer or similar heavy-duty fastener. With some attachments this link is not necessary. Some support straps will attach directly to seat loop.

Seat loop 3 is made of comparable material to the material used for the strap 1. Loop 3 is threaded through a hem in the seat 4. Loop 3 is made with a piece of webbing 18-inches long with a 1 to 2-inch overlap with three seems sewn for strength, creating a loop 8 inches across. Before sewing the webbing it must be woven through the hem in the seat 4.

Seat 4 is constructed of a heavyweight, durable material such as, but not limited to, duck canvas. The dimensions may vary depending on model produced whether it is made for a child or an adult. A mid sized adult version can be made by taking a piece of duck canvas 20"×24" and, folding it in half and hemmed 2" at each end creating a seat surface 10" wide by 20" long. Folding the canvas in half is done to improve the strength of material for extra support. Seat size may vary to accommodate the size of the user.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

I claim:

1. A support for suspending between a pair of crutches, comprising:

a generally rectangular planar seat having first and second ends, said first and second ends formed at opposite ends of a longitudinal axis of said seat;

a first loop attached to said first end of said seat;

a second loop attached to said second end of said seat;

a first strap formed by a continuous loop of material, wherein said first strap is configured for draping over a first horizontal underarm support of a first crutch, of said pair of crutches, such that a fold of said first strap hangs down from each side of said first horizontal underarm support;

a second strap formed by a continuous loop of material, wherein said second strap is configured for draping over a second horizontal underarm support of a second crutch, of said pair of crutches, such that a fold of said second strap hangs down from each side of said second horizontal underarm support;

a first removable link inserted through the two folds of said first strap and said first loop to support said first end of said seat from said first horizontal underarm support; and a second removable link inserted through the two folds of said second strap and said second loop to support said second end of said seat from said second horizontal underarm support.

2. The support of claim 1, wherein the first and second removable links are carabineer links.

3. A support for suspending between a pair of crutches, comprising:

a generally rectangular planar seat having first and second ends, said first and second ends formed at opposite ends of a longitudinal axis of said seat;

a first loop attached to said first end of said seat;

a second loop attached to said second end of said seat;

a first strap formed by a continuous loop of material, wherein said first strap is configured for draping over a first horizontal underarm support of a first crutch, of said pair of crutches, and a first fold of said first strap is inserted through the opening of a second fold of said first strap;

a second strap formed by a continuous loop of material, wherein said second strap is configured for draping over a second horizontal underarm support of a second crutch, of said pair of crutches, and a first fold of said second strap is inserted through the opening of a second fold of said second strap;

a first removable link inserted through said first fold of said first strap and said first loop to support said first end of said seat from said first horizontal underarm support; and a second removable link inserted through said first fold of said second strap and said second loop to support said second end of said seat from said second horizontal underarm support.

4. The support of claim 3, wherein the first and second straps are configured for winding around the first and second underarm supports, respectively, a number of times before the first folds of the first and second straps are inserted through the openings of the second folds of the first and second straps, respectively.

5. The support of claim 4, wherein the first and second removable links are carabineer links.

6. The support of claim 3, wherein the first and second removable links are carabineer links.

7. A support for suspending between a pair of crutches, consisting of:

a generally rectangular planar seat having first and second ends, said first and second ends formed at opposite ends of a longitudinal axis of said seat;

a first loop attached to said first end of said seat;

a second loop attached to said second end of said seat;

a first strap formed by a continuous loop of material, wherein said first strap is configured for draping over a first horizontal underarm support of a first crutch, of said pair of crutches, such that a fold of said first strap hangs down from each side of said first horizontal underarm support;

a second strap formed by a continuous loop of material, wherein said second strap is configured for draping over a second horizontal underarm support of a second crutch, of said pair of crutches, such that a fold of said second strap hangs down from each side of said second horizontal underarm support;

a first removable link inserted through the two folds of said first strap and said first loop to support said first end of said seat from said first horizontal underarm support; and a second removable link inserted through the two folds of said second strap and said second loop to support said second end of said seat from said second horizontal underarm support.

* * * * *